US007154059B2

(12) United States Patent
Chou

(10) Patent No.: US 7,154,059 B2
(45) Date of Patent: Dec. 26, 2006

(54) UNEVENLY ILLUMINATED KEYBOARD

(75) Inventor: Chin-Wen Chou, Taipei Hsien (TW)

(73) Assignee: Zippy Technoloy Corp., Taipei Hsien (TW)

( * ) Notice: Subject to any disclaimer, the term of this patent is extended or adjusted under 35 U.S.C. 154(b) by 0 days.

(21) Appl. No.: 10/893,492

(22) Filed: Jul. 19, 2004

(65) Prior Publication Data

US 2006/0011459 A1 Jan. 19, 2006

(51) Int. Cl.
*H01H 9/00* (2006.01)

(52) U.S. Cl. ..... 200/314; 200/341

(58) Field of Classification Search ..... 200/310–314, 200/341, 5 A, 510–520, 344, 345; 400/491–491.2, 400/490, 495, 496; 361/680, 687, 688; 362/26, 362/30, 84; 341/22; 345/168
See application file for complete search history.

(56) References Cited

U.S. PATENT DOCUMENTS

| | | | | |
|---|---|---|---|---|
| 4,017,700 | A * | 4/1977 | West | 200/314 |
| 4,060,703 | A * | 11/1977 | Everett, Jr. | 200/5 A |
| 4,163,883 | A * | 8/1979 | Boulanger | 200/314 |
| 5,120,920 | A * | 6/1992 | Moriike | 200/341 |
| 5,434,757 | A * | 7/1995 | Kashiwagi | 362/501 |
| 5,521,345 | A * | 5/1996 | Wulc | 200/317 |
| 5,536,543 | A * | 7/1996 | Papandreou | 428/35.7 |
| 5,878,870 | A * | 3/1999 | Ohtaki | 200/314 |
| 6,040,534 | A * | 3/2000 | Beukema | 200/5 A |
| 6,179,432 | B1 | 1/2001 | Zhang et al. | |
| 6,199,996 | B1 | 3/2001 | Katrinecz et al. | |
| 6,284,988 | B1 | 9/2001 | Watanabe et al. | |
| 6,322,229 | B1 | 11/2001 | Chan et al. | |
| 6,545,232 | B1 * | 4/2003 | Huo-Lu | 200/5 A |
| 6,554,442 | B1 | 4/2003 | Chou | |
| 6,609,805 | B1 * | 8/2003 | Nelson | 362/30 |
| 6,686,549 | B1 * | 2/2004 | Douzono et al. | 200/341 |
| 6,743,993 | B1 * | 6/2004 | Clark et al. | 200/314 |
| 6,860,612 | B1 * | 3/2005 | Chiang et al. | 362/29 |

FOREIGN PATENT DOCUMENTS

| | | |
|---|---|---|
| TW | 438035 | 5/2001 |
| TW | 465777 | 11/2001 |
| TW | 468833 | 12/2001 |
| TW | 509955 | 11/2002 |
| TW | 516671 | 1/2003 |
| TW | 535385 | 6/2003 |
| TW | 570235 | 1/2004 |

* cited by examiner

*Primary Examiner*—Michael Friedhofer
*Assistant Examiner*—Lisa Klaus
(74) *Attorney, Agent, or Firm*—Birch, Stewart, Kolasch & Birch, LLP

(57) ABSTRACT

An unevenly illuminated keyboard has a mask element between a luminous element and keycaps which are illuminated by the luminous element. The mask element has a permeable zone corresponding to each keycap and an impermeable zone on the neighboring area of the keycap but not beneath thereof such that the light emitted from the luminous element projects and illuminates the individual keycap to form the unevenly illuminated keyboard that illuminates only the keycaps.

22 Claims, 9 Drawing Sheets

UNEVENLY ILLUMINATED KEYBOARD

FIELD OF THE INVENTION

The present invention relates to an unevenly illuminated keyboard and particularly to an illuminated keyboard that provides illumination to individual keycaps without generating light interference among them.

BACKGROUND OF THE INVENTION

There are many references disclosed in the prior art regarding the illuminated keyboard for desktop computers, laptop or notebook computers, or network TVs to make the keyboard visible in a low light or dark environment and to facilitate keyboard strike operation, such as U.S. Pat. Nos. 6,284,988, 6,322,229, 6,199,996, 6,554,442, and 6,179,432, and R.O.C. patent publication Nos. 509955, 465777, 535385, 438035, 570235, 468833, and 516671. They mostly include an embedded luminous sheet to emit light to enable users to recognize the striking position of the keyboard.

They also have a common feature, i.e. the luminous element and the keycap are spaced only by an elastic member and an actuating mechanism. And most of them have the keycap, elastic member and actuating mechanism made from permeable material (some have the keycap made from impermeable material, but the character symbol on the keycap is made from the permeable material) so that when the entire luminous sheet emits light, the keyboard has an even backlight. Such type of illumination creates problems for users when in use. This is because the illuminated keyboard usually is used in a low light environment such as in an airplane, car and the like where the ambient light is weak. The evenly lighted keyboard makes the luminosity of the entire body too strong and affects the surrounding people. Moreover, the visibility of the keyboard is generally low in such an environment, with the entire plate evenly lighted, it is more difficult to recognize the symbol on each keycap. Even if the symbol is made from the impermeable material, or the keycap is made from the impermeable material and the symbol is made from permeable material, light emitting from the neighboring keycaps will create light interference and make recognition difficult. For users who are not familiar with the keycap symbols, striking errors often occur and wrong instructions are made frequently.

SUMMARY OF THE INVENTION

The primary object of the present invention is to solve the aforesaid disadvantages. The present invention provides a mask element between a luminous element that generates light and a keycap which receives the light. The mask element has a permeable zone corresponding to each keycap and an impermeable zone on the neighboring keycaps not beneath the keycap so that the light emitted from the luminous element projects only the keycap to generate illumination and form an unevenly illuminated keyboard.

Another object of the invention is to provide a mask element, or a circuit board that functions like the mask, or a circuit board coating with a mask layer between the keycap and the luminous element.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
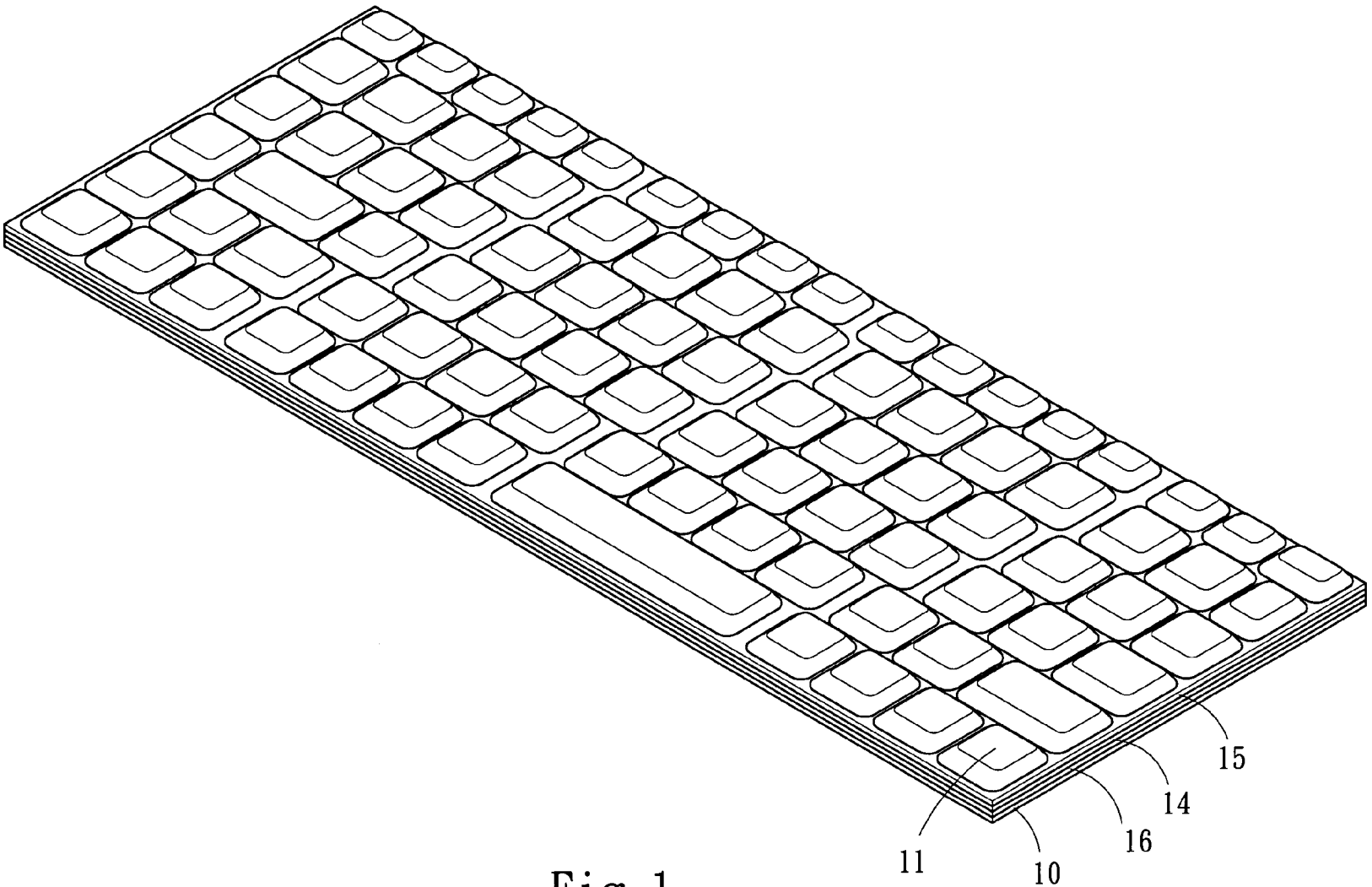
FIG. 1 is a perspective view of the illuminated keyboard of the present invention.
Figure 2:
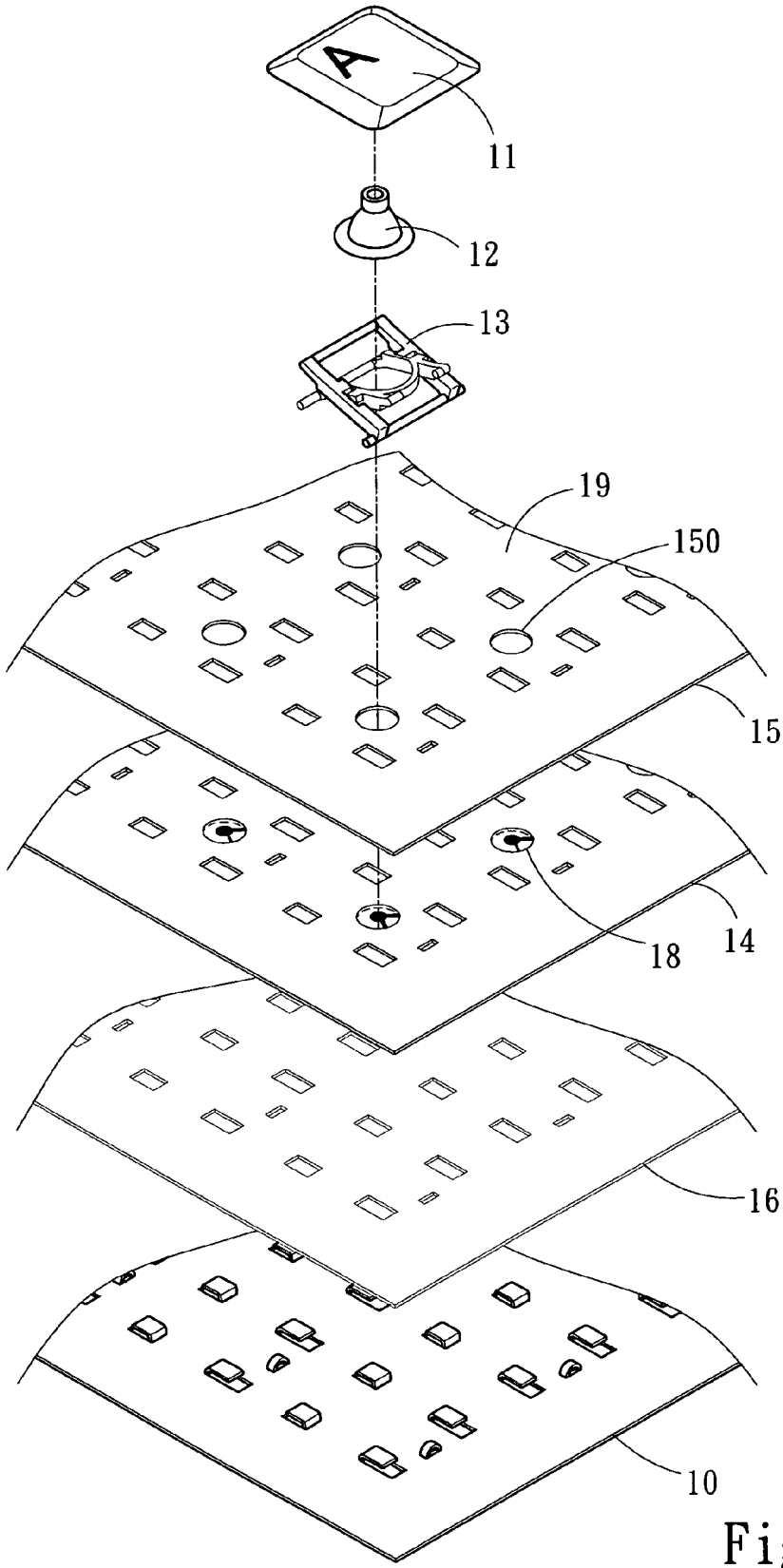
FIG. 2 is an exploded view of a first embodiment of the present invention.
Figure 3:
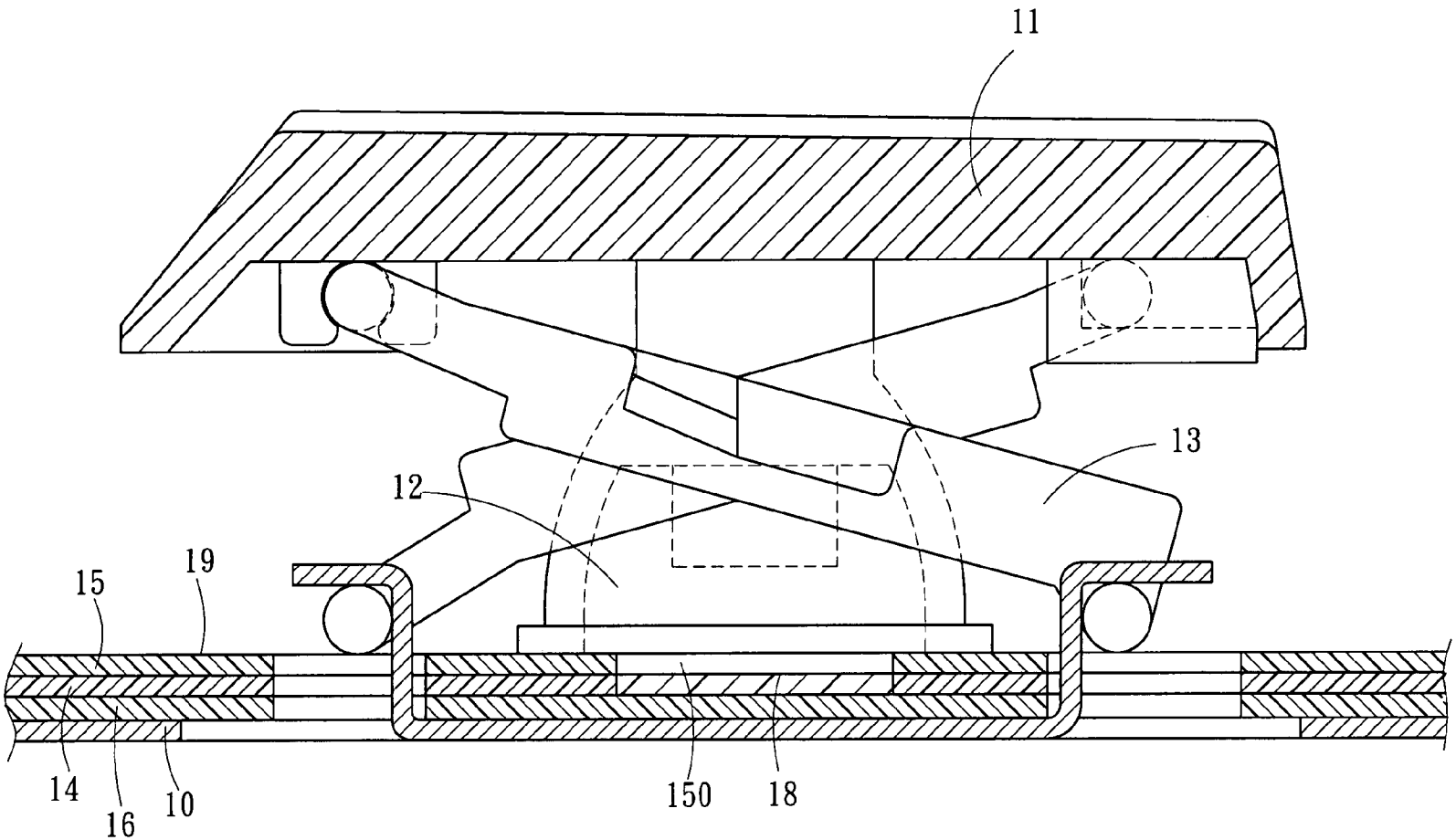
FIG. 3 is a sectional view of the first embodiment of the present invention.

Please refer to FIGS. 1, 2 and 3 for a first embodiment of the present invention. The unevenly illuminated keyboard according to the invention includes a base board 10, a plurality of keycaps 11 movable up and down relative to the base board 10. There are an elastic member 12 and an actuating mechanism 13 located between the keycap 10 and the base board 10 to provide the up and down movement for the keycap 11 relative to the base board 10. The keyboard further has a circuit board 14 to receive the compression of the keycaps 11 to generate signal outputs. The circuit board 14 is located between a mask element 15 and a luminous element 16. The circuit board 14 has a permeable zone 18 underneath the keycap 11. The luminous element 16 is an electroluminescent sheet located between the base board 10 and the keycaps 11. The luminous element 16 projects light to illuminate the keycaps 11. The feature of the invention is the mask element 15 between the keycaps 11 and the luminous element 16. The mask element 15 has an aperture 150 corresponding to the permeable zone 18 for each keycap 11, and the neighboring area of the keycap 11 but not underneath thereof is an impermeable zone 19. Hence light emitted from the luminous element 16 projects to the individual keycap 11 to generate illumination to form an unevenly illuminated keyboard which illuminates only the keycaps 11.

In the first embodiment, the keycaps 11, elastic member 12, circuit board 14 and actuating mechanism 13 are made from a permeable material. When the luminous element 16 is energized by electricity and projects light towards the keycaps 11, the light passes through only the permeable zone 18 of the mask element 15 to illuminate each keycap 11, but is blocked by the impermeable zone 19 of the mask element 15. As the keycaps 11 are spaced from one another at a selected distance, the lighting keycaps 11 do not interfere with the neighboring keycaps. Therefore users can easily recognize the location of the individual keycap 11 in the low light ambient. Moreover, as the keycaps 11 are illuminated individually, the symbols on the keycaps 11 may be highlighted to facilitate user striking. This is especially helpful to the users who are not familiar to keyboard operation.

Figure 4:
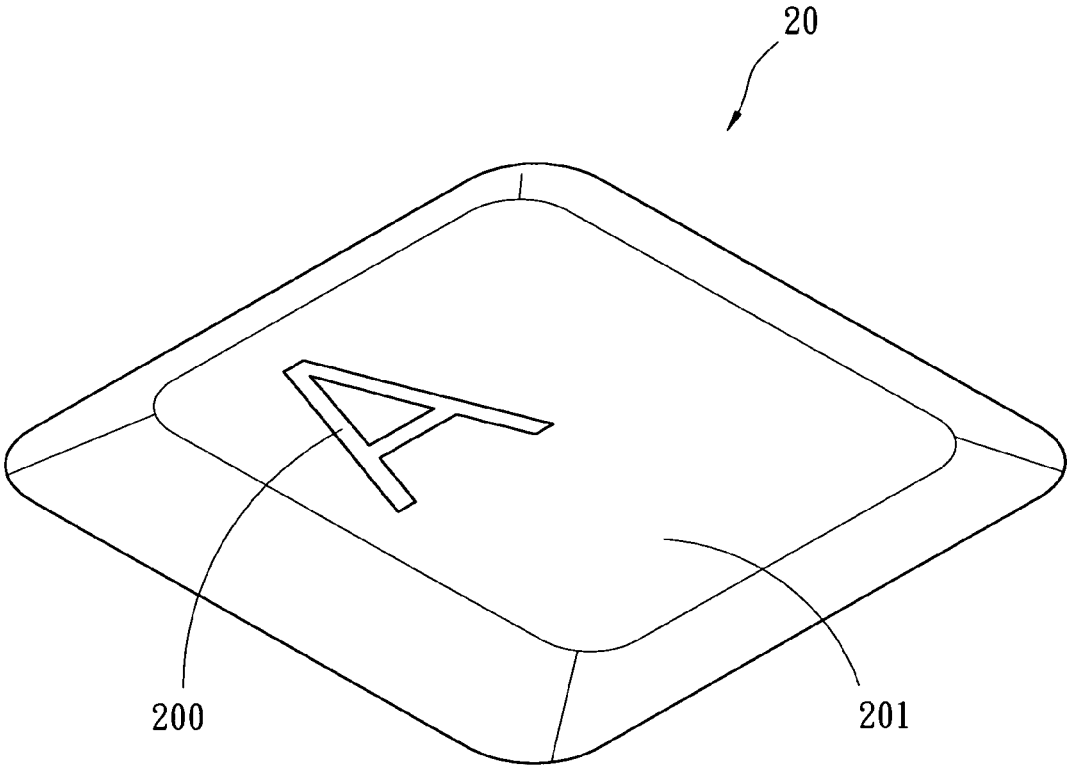
FIG. 4 is a schematic view of another embodiment of the keycap.

Refer to FIG. 4 for another form of keycap 20. As the illuminated area of the invention is limited to the individual keycap 20, the keycap 20 may adopt a design with a symbol 200 formed thereon and an impermeable layer 201 coated on the area outside the symbol, or with the impermeable layer 201 coated first on the keycap 20 and the symbol 200 carved on the impermeable layer 201. Thus only the symbol 200 on the keycap 11 is permeable and illuminates light. It is easier to identify among the neighboring keycaps. Such a design functions well in the low light environment without affecting the people nearby, also can reduce eye fatigue and enhance recognition of the keycap 20.

Figure 5:
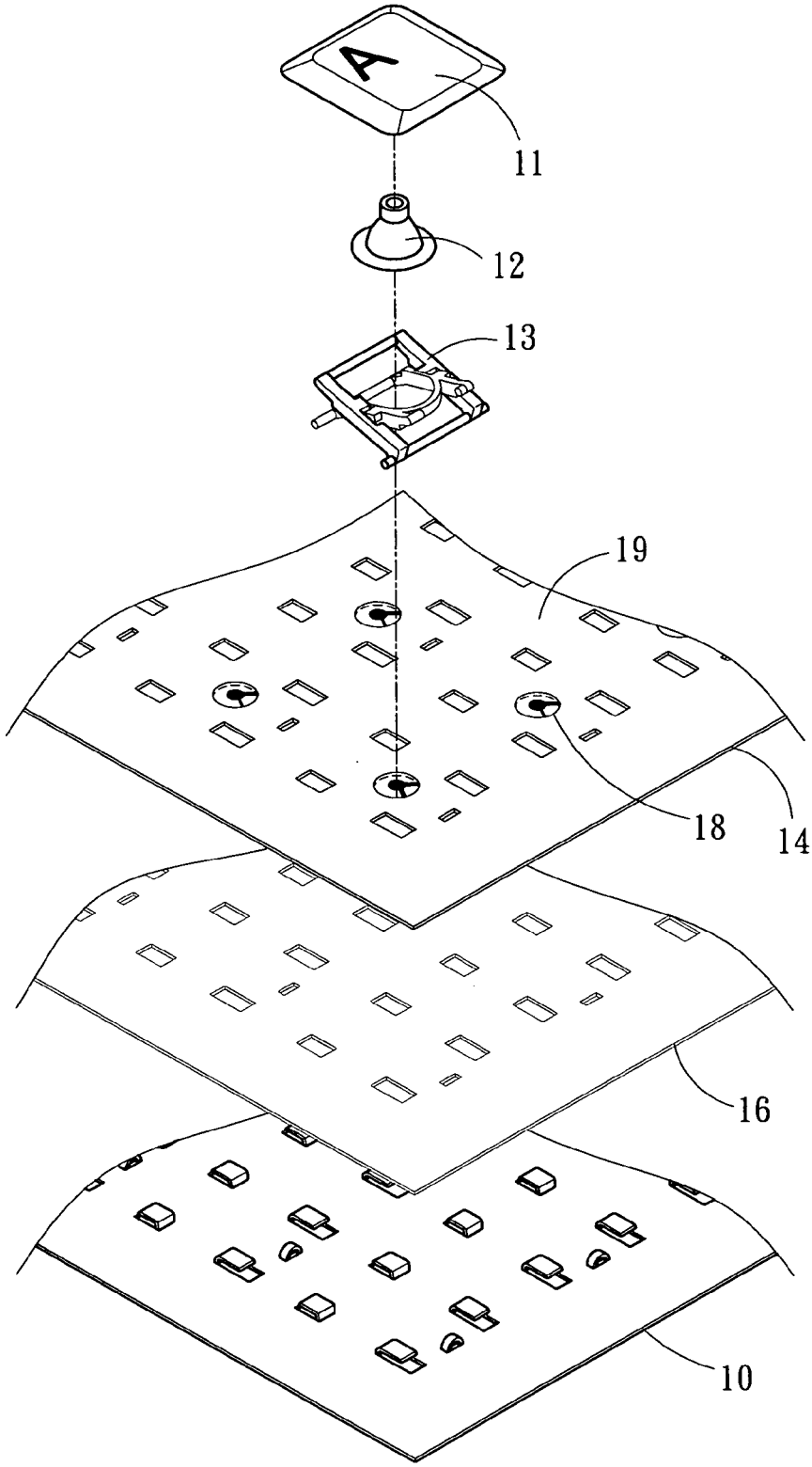
FIG. 5 is an exploded view of a second embodiment of the present invention.
Figure 6:
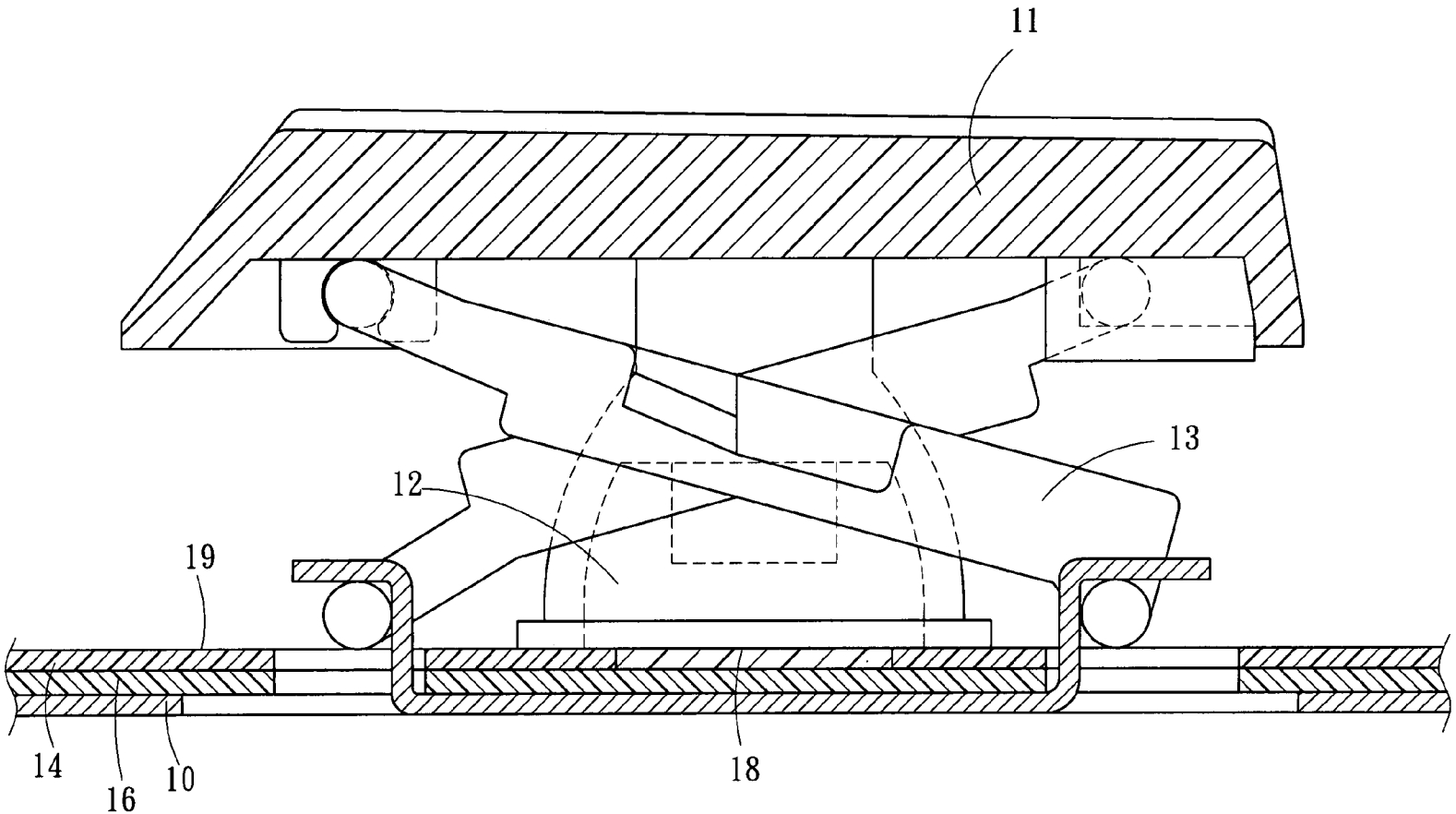
FIG. 6 is a sectional view of the second embodiment of the present invention.

Refer to FIGS. 5 and 6 for a second embodiment of the invention. It differs from the previous embodiment by having the circuit board 14 to function as the mask element 15 to confine the illumination area. The circuit board 14 is located between the keycaps 11 and the luminous element 16. The circuit board 14 has a permeable zone 18 corresponding to each keycap 11. The neighboring area of the keycap 11 but not underneath thereof is an impermeable zone 19. Thus the light emitted from the luminous element 16 projects to the individual keycap 11 to generate light and form an unevenly illuminated keyboard that illuminates only the keycaps 11.

Figure 7:
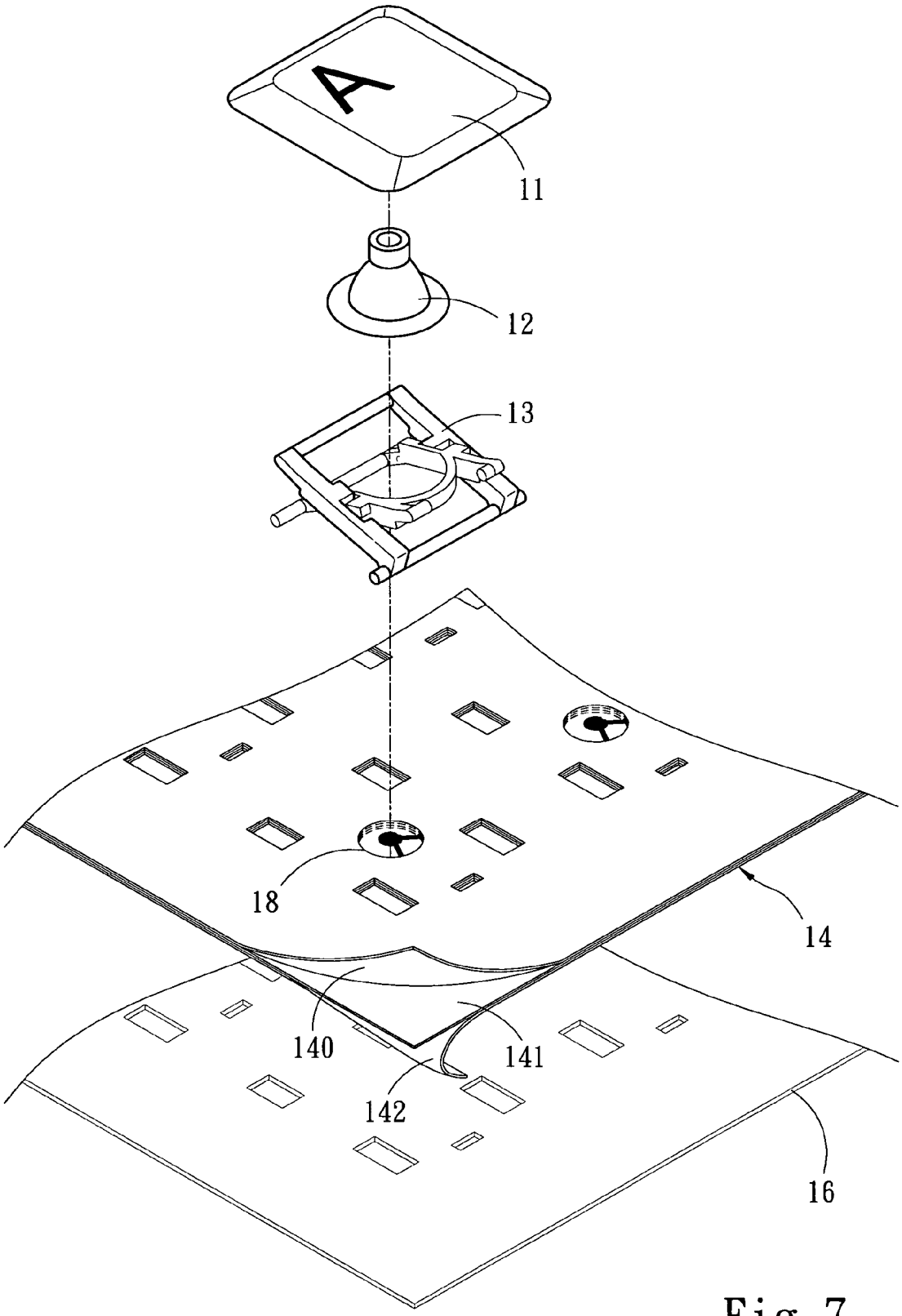
FIG. 7 is a schematic view of the circuit board of present invention for assembly.

Referring to FIG. 7, the circuit board 14 may adopt a double-layer or triple-layer design. For a triple-layer circuit board 14, it consists of a upper film 140, a spacer film 141 and a lower film 142. Each film is made from impermeable material. The permeable zone 18 is formed corresponding to the keycap 11. The circuit board 14 can mask light emitted from the luminous element 16 except the keycaps 11. The keycap 20 shown in FIG. 4 may also be adopted.

Figure 8:
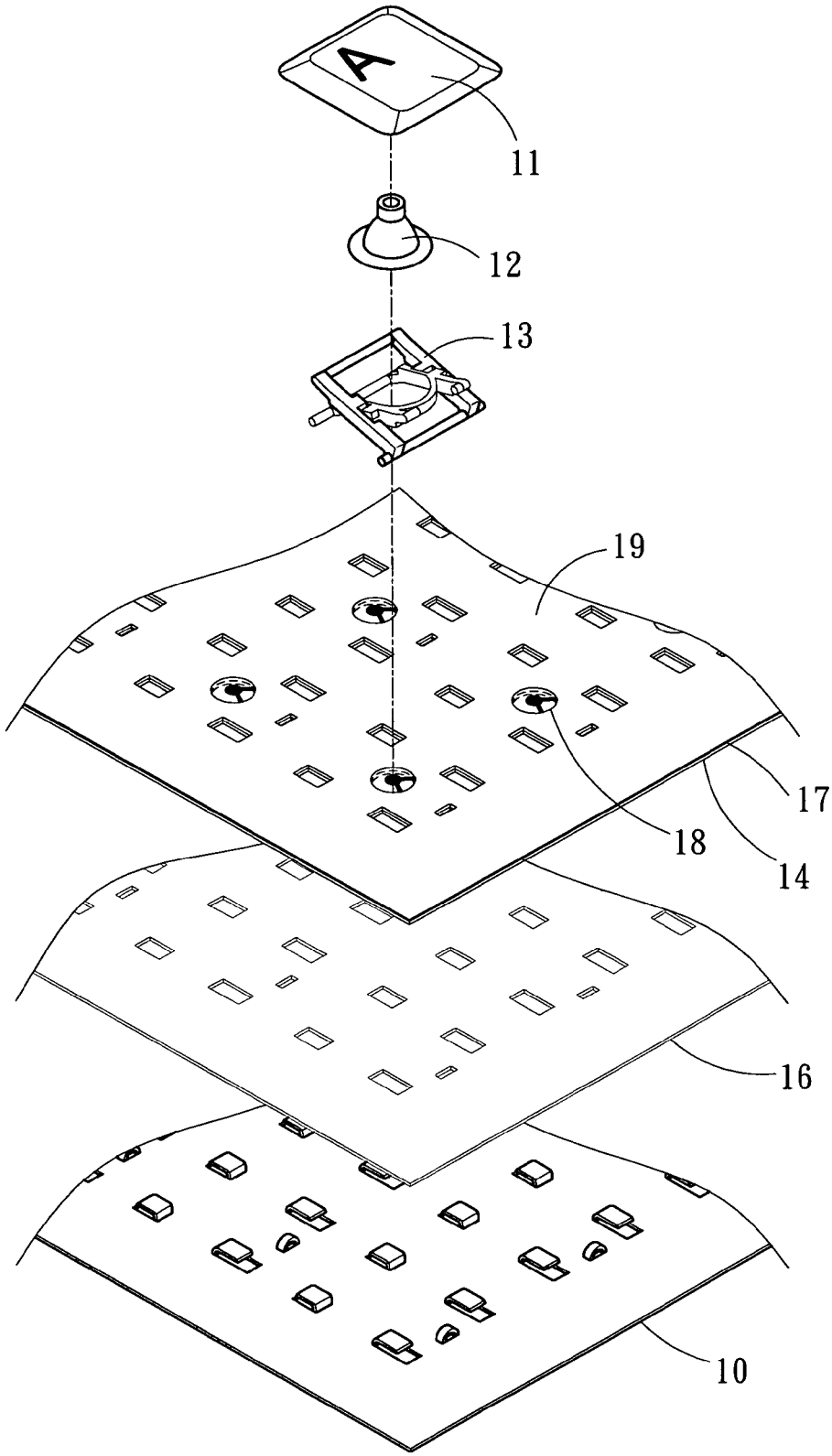
FIG. 8 is an exploded view of a third embodiment of the present invention.
Figure 9:
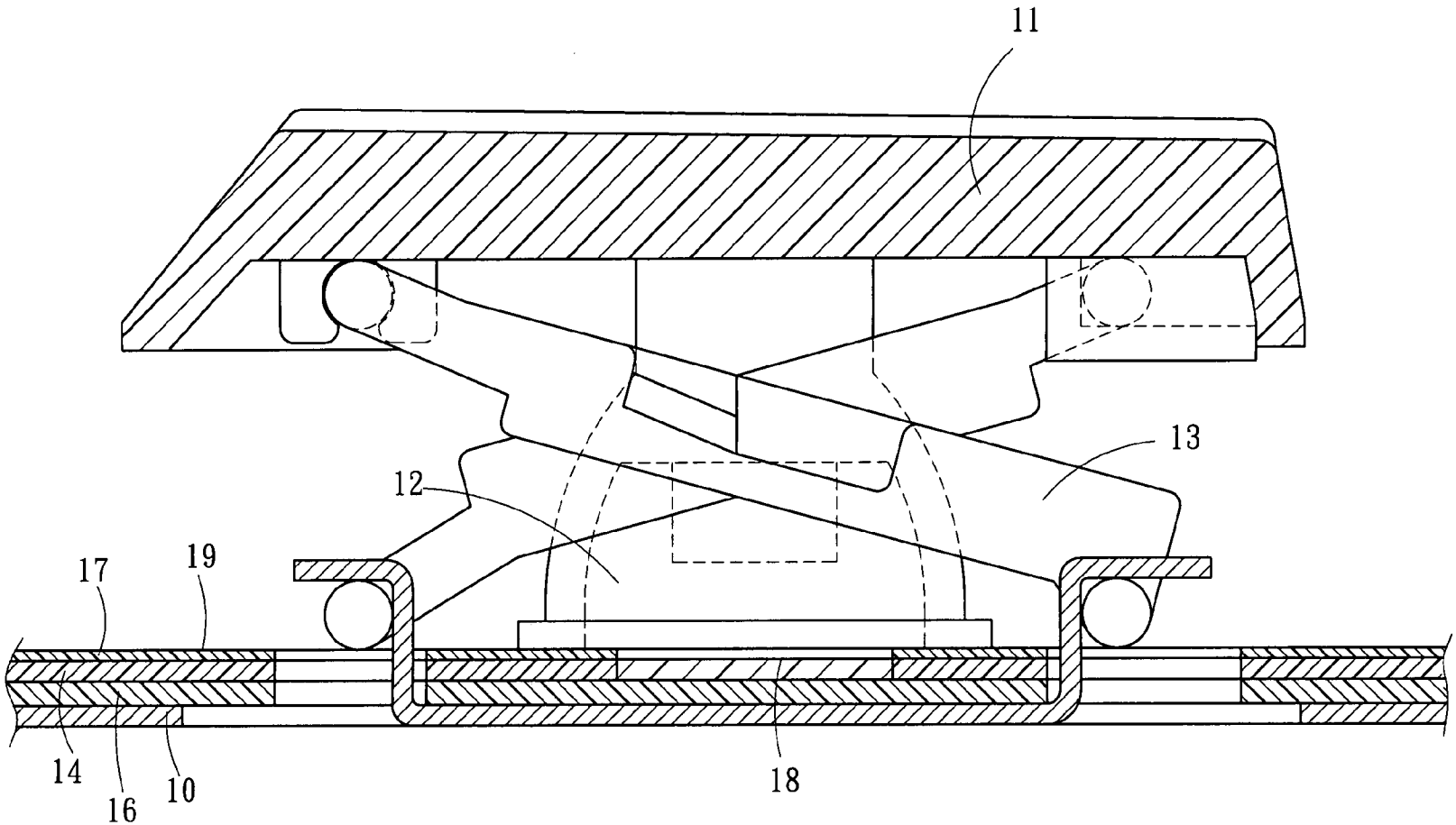
FIG. 9 is a sectional view of the third embodiment of the present invention.

Refer to FIGS. 8 and 9 for a third embodiment of the invention. The circuit board 14 is made from existing permeable material but can confine illumination area like the mask element 15. The feature of this embodiment is to coat a mask layer 17 on the surface of the circuit board 14. The mask layer 17 has a permeable zone 18 corresponding to the individual keycap 11 and an impermeable zone 19 on the neighboring area of the keycap 11 but not underneath thereof. Hence the light projected from the luminous element 16 can illuminate only the individual keycap 11 to form an unevenly illuminated keyboard.

The embodiment set forth above mainly uses the existing circuit board that is made from permeable material to form a mask layer by printing or coating to block light between the keycaps so that only the individual keycaps are illuminated.

What is claimed is:

1. An unevenly illuminated keyboard comprising a base board having a top side and a bottom side, a plurality of keycaps movable up and down relative to the base board, the keycaps being on the top side of the base board, a circuit board for receiving compression from the keycaps to generate signal outputs, and a luminous element located between the top side of the base board and the keycaps to emit light to illuminate the keycaps, wherein:

the keycaps and the luminous element are interposed by a mask element which has a permeable zone corresponding to each keycap and an impermeable zone on the neighboring area of the keycap but not beneath thereof such that the light emitting from the luminous element projects and illuminates the individual keycap to form the unevenly illuminated keyboard that illuminates only the keycaps.

2. The unevenly illuminated keyboard of claim 1, wherein the keycaps are made from permeable material.

3. The unevenly illuminated keyboard of claim 1, wherein the keycaps are made of permeable material and have a symbol formed thereon, and the keycaps are coated with an impermeable layer on the area other than the symbol.

4. The unevenly illuminated keyboard of claim 3, wherein the keycaps are coated with an impermeable layer and carved a symbol on the impermeable layer.

5. The unevenly illuminated keyboard of claim 1 further having an elastic member and an actuating mechanism between the keycaps and the base board that are made from permeable material to allow the keycaps to move up and down relative to the base board.

6. The unevenly illuminated keyboard of claim 1, wherein the luminous element is an electroluminescent sheet.

7. The unevenly illuminated keyboard of claim 1, wherein the circuit board is located between the mask element and the luminous element, the circuit board having permeable zones beneath the keycaps.

8. The unevenly illuminated keyboard of claim 1, wherein the impermeable zone is a light impermeable zone which is adjacent at least a majority of the keycaps and wherein the mask element is below the keycaps so that the mask element is between the keycaps and the circuit board, the circuit board being between the mask element and the luminous element.

9. An unevenly illuminated keyboard comprising a base board having a top side and a bottom side, a plurality of keycaps movable up and down relative to the base board, the keycaps being on the top side of the base board, a circuit board for receiving compression from the keycaps to generate signal outputs, and a luminous element located between the top side of the base board and the keycaps to emit light to illuminate the keycaps, wherein:

the circuit board is located between the keycaps and the luminous element and has a permeable zone corresponding to each keycap and an impermeable zone on the neighboring area of the keycap but not beneath thereof such that the light emitted from the luminous element projects and illuminates the individual keycap to form the unevenly illuminated keyboard that illuminates only the keycaps.

10. The unevenly illuminated keyboard of claim 9, wherein the keycaps are made from permeable material.

11. The unevenly illuminated keyboard of claim 9, wherein the keycaps are made of permeable material and have a symbol formed thereon, and the keycaps are coated with an impermeable layer on the area other than the symbol.

12. The unevenly illuminated keyboard of claim 11, wherein the keycaps are coated with an impermeable layer and carved a symbol on the impermeable layer.

13. The unevenly illuminated keyboard of claim 9 further having an elastic member and an actuating mechanism between the keycaps and the base board that are made from permeable material to allow the keycaps to move up and down relative to the base board.

14. The unevenly illuminated keyboard of claim 9, wherein the luminous element is an electroluminescent sheet.

15. The unevenly illuminated keyboard of claim 9, wherein the impermeable zone is a light impermeable zone which is adjacent at least a majority of the keycaps and wherein the circuit board is below the keycaps so that the circuit board is between the keycaps and the luminous element.

16. An unevenly illuminated keyboard comprising a base board having a top side and a bottom side, a plurality of keycaps movable up and down relative to the base board, the keycaps being on the top side of the base board, a circuit board for receiving compression from the keycaps to generate signal outputs, and a luminous element located between the top side of the base board and the keycaps to emit light to illuminate the keycaps, wherein:

the circuit board is located between the keycaps and the luminous element and coating with a mask layer on the surface that has a permeable zone corresponding to each keycap and an impermeable zone on the neighboring area of the keycap but not beneath thereof such that the light emitting from the luminous element projects and illuminates the individual keycap to form the unevenly illuminated keyboard that illuminates only the keycaps.

17. The unevenly illuminated keyboard of claim 16, wherein the keycaps are made from permeable material.

18. The unevenly illuminated keyboard of claim 16, wherein the keycaps are made of permeable material and have a symbol formed thereon, and is coated with an impermeable layer on the area other than the symbol.

19. The unevenly illuminated keyboard of claim 18, wherein the keycaps are coated with an impermeable layer and carved a symbol on the impermeable layer.

20. The unevenly illuminated keyboard of claim 16 further having an elastic member and an actuating mechanism between the keycaps and the base board that are made from permeable material to allow the keycaps to move up and down relative to the base board.

21. The unevenly illuminated keyboard of claim 16, wherein the luminous element is an electroluminescent sheet.

22. The unevenly illuminated keyboard of claim 16, wherein the impermeable zone is a light impermeable zone which is adjacent at least a majority of the keycaps and wherein the mask layer is below the keycaps so that the mask layer is between the keycaps and the circuit board, the circuit board being between the mask layer and the luminous element.

* * * * *